United States Patent [19]

Helmersson

[11] Patent Number: 4,660,496

[45] Date of Patent: Apr. 28, 1987

[54] REMOTELY RELEASABLE CONNECTIONS AT A FLOATING PROCESSING PLANT

[75] Inventor: Rickard Helmersson, Göteborg, Sweden

[73] Assignee: Gotaverken Arendal AB, Gothenburg, Sweden

[21] Appl. No.: 760,552

[22] Filed: Jul. 30, 1985

[30] Foreign Application Priority Data

Aug. 8, 1984 [SE] Sweden ..... 8404011

[51] Int. Cl.[4] ..... B63B 35/00

[52] U.S. Cl. ..... 114/264; 114/265; 166/356; 166/359

[58] Field of Search ..... 114/335, 256, 230, 258, 114/259, 264, 265; 166/352, 356, 359; 175/8; 441/4; 405/224

[56] References Cited

U.S. PATENT DOCUMENTS

| | | | |
|---|---|---|---|
| 3,080,583 | 3/1963 | Fuller | 114/264 |
| 3,389,671 | 6/1968 | Yost | 114/265 |
| 3,525,388 | 8/1970 | McClintock | 166/356 |
| 3,572,043 | 3/1971 | Clara | 114/264 X |
| 3,739,736 | 6/1973 | Carreau et al. | 114/230 |
| 4,086,865 | 5/1978 | Statham | 114/230 |
| 4,312,287 | 1/1982 | Kuo | 114/259 |
| 4,478,586 | 10/1984 | Gentry et al. | 441/4 |
| 4,502,551 | 3/1985 | Rule et al. | 166/356 X |

*Primary Examiner*—Sherman D. Basinger
*Assistant Examiner*—Edwin L. Swinehart
*Attorney, Agent, or Firm*—Wegner & Bretschneider

[57] ABSTRACT

In an arrangement including remotely releasable couplings for riser conduits between the sea floor and a floating plant processing crude oil and/or gas, the couplings are located in at least one chamber below the water line of the plant. This chamber is closed towards the atmosphere and provided with at least one downwardly directed opening communicating with the surrounding water. Structure is provided for governing the air pressure in the chamber, which is accessible through an air lock.

4 Claims, 3 Drawing Figures

REMOTELY RELEASABLE CONNECTIONS AT A FLOATING PROCESSING PLANT

BACKGROUND OF THE INVENTION

The present invention refers to an arrangement including remotely releasable connections for riser conduits between the sea floor and a floating plant processing crude oil and/or gas.

For the production of crude oil and/or gas from sub-sea wells the floating plant is connected with the well, or wells, by way of an umbilical of rigid pipes or flexible, reinforced hoses, designed to withstand high pressures.

These pipes or hoses may be attached to remotely releasable couplings located outside the hull of the plant, either above or below the water line. These couplings are necessary to make possible a removal of the plant from the potential sources of danger represented by sub-sea wells for oil or gas. Remote control is required for a rapid release in case of danger, for instance if the mooring arrangement, or the dynamic positioning machinery should fail.

When the couplings are located above water level there is a risk that the pipes or the hoses are damaged if the plant collides with an other vessel, or with an iceberg.

Couplings located below the water level run considerably less risk of being damaged by icebergs, and are well protected from collision with surface vessels. A drawback is, however, that couplings below the water level require divers or diving equipment for overhauling. This kind of work implies great risks, and involves high costs.

The aim of the present invention is to provide an arrangement of remotely releasable couplings at riser conduits for floating production plants, where the above-mentioned drawbacks are removed.

SUMMARY OF THE INVENTION

The invention thus relates to a floating plant processing crude oil and/or gas, which is supplied from the sea floor by at least one riser conduit, which passes into a chamber, which is open downwards to the ambient water, the level of which within the chamber is balanced by air pressure and is characterized in that the chamber is accessible through an air lock and that the riser conduit is by means of remotely releasable locking members, connectable to a transport conduit extending into the chamber and that means are provided for controlling the air pressure within the chamber.

According to an advantageous embodiment the deck of the chamber is provided with at least one lock permitting the passage of the wire of a winch for retracting a released riser conduit through the opening.

The opening is preferably provided with a guiding sleeve facilitating the introduction of the riser conduit through the opening.

The chamber may form part of the ballast system of the production plant and the opening is advantageously located in the bottom plating of the plant.

DESCRIPTION

Figure 1:
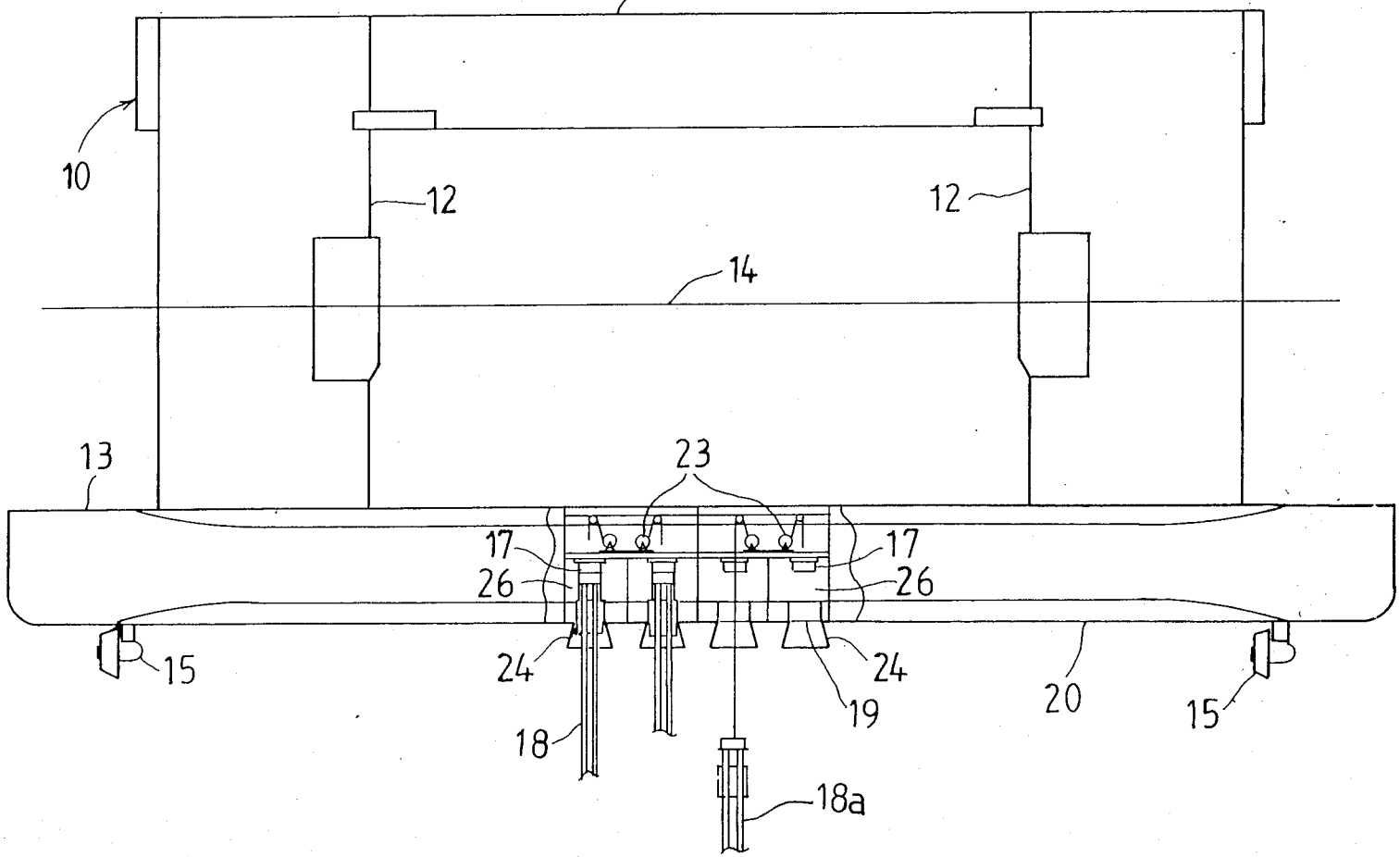
FIG. 1 schematically shows an elevation of a production plant having riser conduits attached according to the invention.
Figure 2:
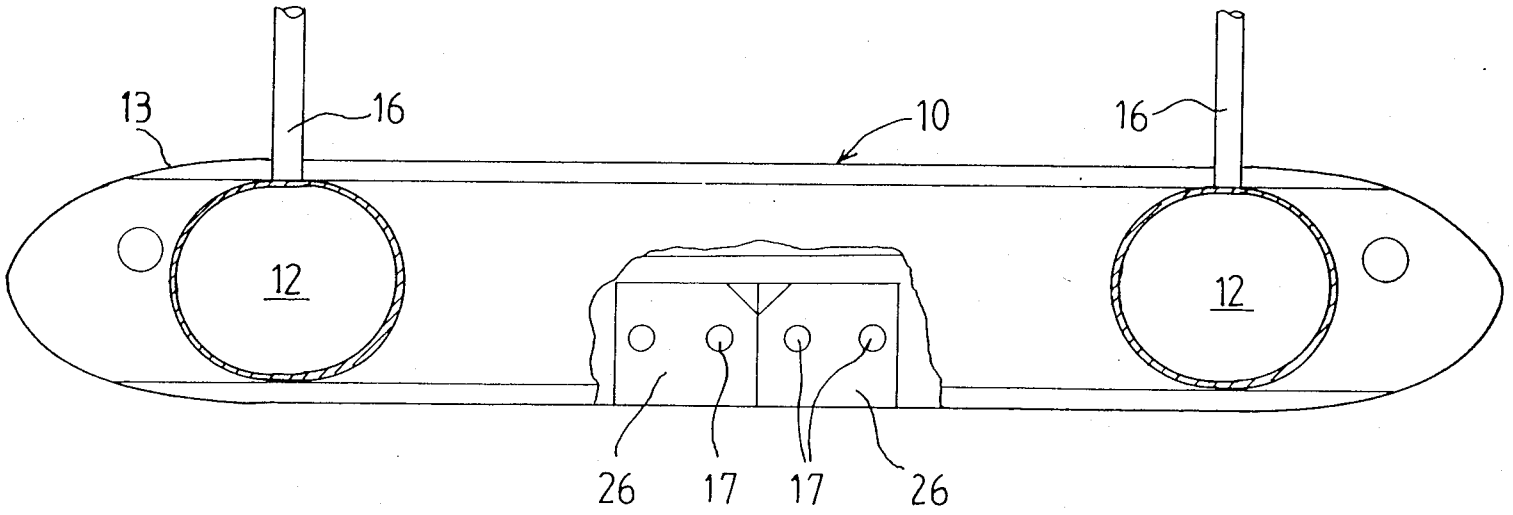
FIG. 2 shows a pontoon forming part of the plant, as seen from above, and FIG. 3 on a larger scale shows the connection between the riser conduits and the plant.

The production plant 10 shown in FIG. 1 comprises an operating deck 11, which is supported by four columns 12 from two pontoons 13. The columns and the pontoons are in a conventional manner provided with ballast tanks for adjusting the draft in relation to an operation water level 14, and the trim of the plant in respect to wind forces and loads upon the deck 11. Each pontoon 13 is provided with two thruster propellers 15, for propulsion and positioning. As is evident from FIG. 2 the columns are interconnected by cross bracings 16.

Riser conduits extending from the sea floor are attached to couplings 17 located within the pontoons 13, FIG. 1 shows four such couplings 17. Riser conduits 18 are connected to two of those, while a third riser conduit **18*a* is about to be connected to a third coupling 17. These riser conduits 18**, which each may include one or more hoses or pipes terminated by hose end portions are connected to different wells in the sea floor, and are used to draw oil or gas from the wells, or to force water into some of them.

Figure 3:
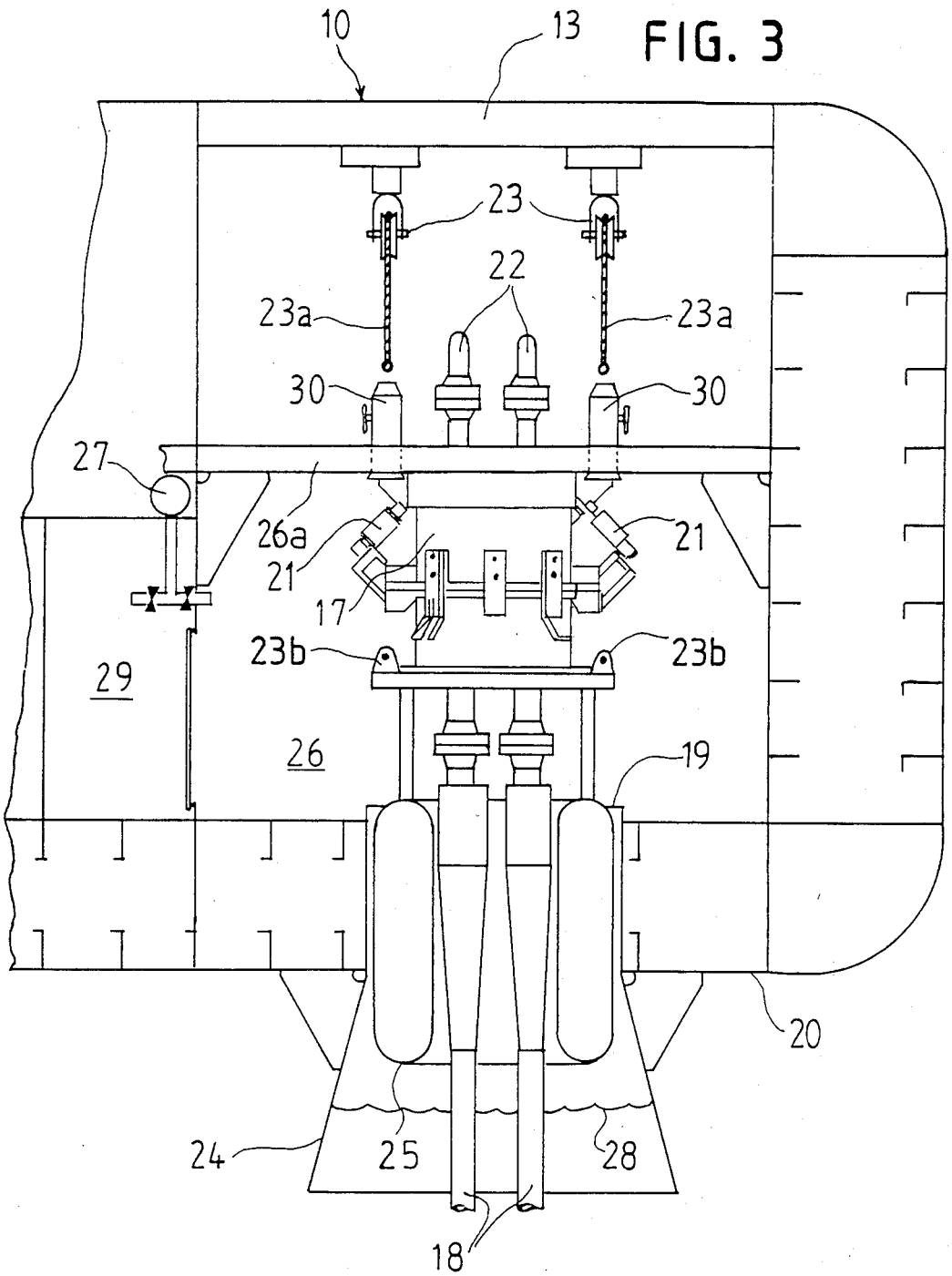

FIG. 3 on a larger scale shows the couplings 17 within a pontoon 13. The riser conduits 18 extend vertically through an opening 19 in the bottom plating 20 of the hull, and is by means of releasable locking members 21 retained at the couplings 17. From the latter transport conduits 22 extend horizontally through the pontoon 13 to the columns 12 at the ends thereof. Conduits in the latter are connected to apparatus for separating and purifying oil and gas, and to storage tanks.

The hauling in of a riser conduit 18 through opening 19 is obtained by means of two winches 23, the wires of which may be attached to eye bolts **23*b* located to each side of the couplings part at the riser conduit end. The introduction is facilitated by the opening 19 being provided with a govering sleeve 24, which conically diverges downwardly. The portion of the riser conduit 18 to be located within the opening 19 is provided with a collar 25, which has a certain buoyancy and prevents wear of the reinforced hoses of the riser conduit 18. The buoyant collar 25** protects the end of a released riser conduit when hitting the sea floor.

The chamber 26, which encloses the opening 19 and the couplings 17 is closed from the atmosphere in the other parts of the pontoon 13. Air is however supplied to the chamber 26 by means of a compressor 27. By means of the compressor 27 it is possible to expell water from the chamber 26 through the opening 19. In FIG. 3 the water level 28 is about half way up the sleeve 24.

An air lock 29 provides access to the chamber 26 for inspection and overhaul, without the over-pressure in the chamber has to be reduced, which would result in the water level within the chamber rising.

The winches 23 are located in a space within the pontoon 13, above chambers 26. In order to permit the introduction of the winch wires **23*a* into the chamber 26, without the over-pressure therein being lost, two locks 30 are provided in the deck 26*a* of the chamber, directly below the assocated winches 23. The locks 30 are provided with valves, which are closed when the wires are retracted, and sealing washers, which seal against the wires when these are led into the chamber. A slight leakage of air through the locks 30** during a lifting operation is acceptable, as these manoevers occur rather seldom.

The location of the couplings 17 in downwardly open chambers, which may be subjected to air over-pressure provides several advantages:

The couplings may remain in dry state, which means that they are less subjected to wear caused by corrosion and seaweed growth.

It is not necessary to use divers or diving equipment for inspection and overhaul of the couplings.

The operational safety factor for the remotely controlled locking means 21 is increased.

There is also a reduced risk that the end portion of a released riser pipe will impact upon some adjacent structural member, for instance one of the thruster propellers 15.

The couplings 17 are fully protected from collision with surface vessels and icebergs.

The chamber 26 can be used as part of the ballast system of the plant.

The attachment of the riser conduit 18 and inspection and overhaul of the couplings 17 is advantageously done while the vessel is in transit position, i.e. with the water line about level with the decks of the pontoons 13, when the pressure in the chambers 26 will be comparatively low. The pressure within the chambers 26 will have to be gradually increased as the vessel 10 is ballasted down to its operational draft.

The invention is not limited to the embodiment shown, as many variations are possible within the scope of the appended claims. The handling of the riser conduits 18 may occur by other devices than the winches 23 shown. The chambers 26 for the couplings 17 may be located in vessels of various designs than the one shown, for instance having more columns than four, or more pontoons than two.

What I claim is:

1. In a floating plant for processing crude oil and/or gas which is supplied to the plant from the sea floor by at least one riser conduit, a chamber within said plant defined by a deck and a floor and located below the level of the surrounding water, said chamber having a downwardly directed opening in said floor communicating with the ambient water, at least one transport pipe extending from inside said plant into said chamber, at least one winch supported by said deck and operating a wire, a sealing lock in said deck permitting the passage of said wire for optional connection to said at least one riser conduit for introducing the latter from the outside into said chamber, remotely releasable locking members connnecting said at least one riser conduit when introduced through said opening to said at least one transport pipe, an air lock making said chamber accessible from inside said plant, and means for supplying compressed air to said chamber to control the water level within said chamber.

2. A plant according to claim 1, in which said opening is providing with a guiding sleeve faciliatating the introduction of said riser conduit through the opening.

3. A floating plant for processing crude oil and/or gas which is supplied to the plant from the sea floor by at least one riser conduit, comprising:

an operating platform supported by columns on pontoons, said pontoons having a deck and a floor and being located below the level of the surrounding water;

a chamber within one of the pontoons having a downwardly directed opening in the floor communicating with the ambient water;

at least one transport pipe extending from inside said pontoon into said chamber;

at least one winch supported by said deck and operating a wire;

a sealing lock in said deck permitting the passage of said wire for optional connection to said at least one riser conduit for introducing the later from the outside into said chamber;

remotely releasable locking members connecting said at least one riser conduit when introduced through said opening to said at least one transport pipe;

an air lock, making said chamber accessible from inside said pontoon; and means for supplying compressed air to said chamber to control the water level within said chamber.

4. A plant according to claim 2, in which opening is provided with a guiding sleeve facilitating the introduction of said riser conduit through the opening.

* * * * *